US006032578A

United States Patent [19]

Nakamura

[11] Patent Number: 6,032,578

[45] Date of Patent: Mar. 7, 2000

[54] METHOD FOR CONTROLLING PRINTING DENSITY IN STENCIL PRINTING AND DEVICE FOR THE SAME

[75] Inventor: Yasuo Nakamura, Inashiki-gun, Japan

[73] Assignee: Riso Kagaku Corporation, Tokyo, Japan

[21] Appl. No.: 09/154,155

[22] Filed: Sep. 16, 1998

[30] Foreign Application Priority Data

Sep. 30, 1997 [JP] Japan ..... 9-281195

[51] Int. Cl.[7] ..... B41M 1/12

[52] U.S. Cl. ..... 101/129; 101/116; 101/119; 364/DIG. 2; 364/930

[58] Field of Search ..... 101/114, 116, 101/129, 119; 364/DIG. 2, 930

[56] References Cited

U.S. PATENT DOCUMENTS

| | | | |
|---|---|---|---|
| 5,323,700 | 6/1994 | Katsuyama et al. | 101/119 |
| 5,517,913 | 5/1996 | Oshio et al. | 101/119 |
| 5,740,734 | 4/1998 | Mori et al. | 101/128.21 |
| 5,855,169 | 1/1999 | Mori et al. | 101/116 |
| 5,906,159 | 5/1999 | Mori et al. | 101/116 |
| 5,937,750 | 8/1999 | Takeda | 101/116 |

FOREIGN PATENT DOCUMENTS

| | | |
|---|---|---|
| 62-28757 | 6/1987 | Japan . |
| 62-127276 | 6/1987 | Japan . |
| 5-286221 | 11/1993 | Japan . |
| 6-155880 | 6/1994 | Japan . |

OTHER PUBLICATIONS

Patent Abstracts of Japan vol. 018, No. 479 (M–1669), Sep. 7, 1994 & JP 06 155880 A (Riso Kagaku Corp), Jun. 3, 1994.
Patent Abstracts of Japan vol. 017, No. 198 (M–1398), Apr. 19, 1993 & JP 04 344283 A (Omron Corp), Nov. 30, 1992
Patent Abstracts of Japan vol. 018, No. 479 (M–1669), Sep. 7, 1994 & JP 06 155882 A (Riso Kagaku Corp), Jun. 3, 1994.

*Primary Examiner*—Eugene Eickholt
*Attorney, Agent, or Firm*—Pillsbury Madison & Sutro LLP

[57] ABSTRACT

In a stencil printing in which a perforated stencil sheet is wound around a circumferential surface of a printing drum to which an ink is supplied, and the ink is transferred from the printing drum to a printing sheet through the perforated stencil sheet by pressing the printing sheet to the printing drum while the drum is rotated, a method for controlling a printing density is provided, which comprises controlling an amount of an ink transferred to a printing sheet by selecting a specific value of D from a range predetermined in accordance with the following equation:

$$D=\sqrt{(F/f)}$$

in which F is a possible range of pressing force at which the printing sheet is pressed to the drum, and f is a possible range of rotation speed of the drum. Also provided is a printing density controlling device for stencil printing which comprises a means for setting a specific value of D within a range predetermined in accordance with the equation above, whereby an amount of the ink transferred to the printing sheet is controlled. A computer program storage medium is also provided which contains a program for controlling a printing density in stencil printing, in which the program calculates a range of f at a selected value of D or a range of D at a selected value of f, in accordance with the equation above.

18 Claims, 5 Drawing Sheets

METHOD FOR CONTROLLING PRINTING DENSITY IN STENCIL PRINTING AND DEVICE FOR THE SAME

TECHNICAL FIELD

The present invention relates to a method for controlling printing density in stencil printing, which is capable of easily controlling the printing density, and to a device for the same.

BACKGROUND OF THE INVENTION

Well known in the art is a stencil printing device in which a perforated stencil sheet is wound around a circumferential surface of a printing drum with an ink supplied thereto, and in which the ink is transferred from the printing drum to a printing sheet through the perforated stencil sheet by pressing the printing sheet to the printing drum while the drum is rotated.

In a stencil printing above, it has been proposed in Japanese patent laid open publication (Kokai) No. 62-127276 that printing density of an image to be printed on a printing sheet is variably set by variably setting a pressing force to be applied to the printing sheet against the printing drum, in accordance with printing density information given by a means for setting printing density information, for instance, a printing density set up key provided on an operation panel.

Furthermore, since the printing density in stencil printing changes with printing speed, Japanese patent laid open publication (Kokai) No. 06-155880 has already proposed a method for implementing stencil printing at a desired density irrespective of the change in printing speed. This method comprises variably setting a pressing force applied to the printing sheet against the printing drum, in accordance with printing speed information given by a means for setting printing speed information, for instance, a printing speed set up key provided on an operation panel.

With recent diversification in quality of printing paper and originals, there is a demand on a stencil printing device which can more widely and finely control printing density. However, because no index for controlling printing density has been clarified, such a demand could only be satisfied by collecting voluminous data on combinations of a rotation speed of a printing drum and a corresponding pressing force applied to a printing sheet with respect to various printing densities. Thus, it was practically unfeasible to load the entire data into a stencil printing device to control printing density.

BRIEF SUMMARY OF THE INVENTION

In view of such problems as above, an object of the present invention is to provide a method and an apparatus for controlling printing density in stencil printing, which are capable of widely and finely varying the printing density at a desired printing speed.

As a result of the present inventor's intensive studies under the above object, it has been found that quantity of printed ink depends on a value of $\sqrt{(F/f)}$ (where F is a pressing force at which a printing sheet is pressed to a printing drum, and f is a rotation speed of the drum), and more particularly, that the quantity is approximately proportional to the value of $\sqrt{(F/f)}$. This means that, even if rotation speed of the drum is varied, the same printing density can be obtained by performing stencil printing at a pressing force which yields the same value of $\sqrt{(F/f)}$.

Conventionally, degree of pressing force that compensates for a change of printing speed to obtain the same printing density has to be determined only by experience. However, according to the method of the present invention, a printing speed and a pressing force can be readily set by selecting a value of $\sqrt{(F/f)}$ as an index of printing density. Therefore, whether printing is put to trial at a low printing speed or into practice at a high printing speed, or even when printing speed is changed during printing, a printer can be controlled so that copies with a constant printing density are provided independently of printing speed.

In accordance with one aspect of the present invention, there is provided, in a stencil printing in which a perforated stencil sheet is wound around an outer circumferential surface of a printing drum to the inner surface of which an ink is supplied, and the ink is transferred from the printing drum to a printing sheet through the perforated stencil sheet by pressing the printing sheet to the printing drum while the drum is rotated, a method for controlling a printing density which comprises controlling an amount of an ink transferred to a printing sheet by selecting a specific value of D from a range predetermined in accordance with the following equation:

$$D = \sqrt{(F/f)}$$

in which F is a possible range of pressing force at which the printing sheet is pressed to the drum, and f is a possible range of rotation speed of the drum.

The present method for controlling a printing density in stencil printing may comprise a first step of selecting a specific value of D from said predetermined range in order to set a desired printing density, a second step of calculating a possible range of f at the selected value of D and selecting a specific value of f from the calculated range in order to set a desired printing speed, and a third step of calculating a pressing force of F at the selected values of D and f in order to set a pressing force. Furthermore, said second step may comprise a step of calculating a possible range off at the selected value of D and indicating the calculated range of f, and a step of selecting a specific value of from the indicated range in order to set a desired printing speed.

The present method for controlling a printing density in stencil printing may comprise a first step of selecting a specific value of f in order to set a desired printing speed, a second step of calculating a possible range of D at the selected value of f and selecting a specific value of D from the calculated range in order to set a desired printing density, and a third step of calculating a pressing force of F at the selected values of D and f in order to set a pressing force. Furthermore, said second step may comprise a step of calculating a possible range of D at the selected value off and indicating the calculated range of D, and a step of selecting a specific value of D from the indicated range in order to set a desired printing density.

In accordance with another aspect of the present invention, there is provided, in a stencil printing in which a perforated stencil sheet is wound around an outer circumferential surface of a printing drum to the inner surface of which an ink is supplied, and the ink is transferred from the printing drum to a printing sheet through the perforated stencil sheet by pressing the printing sheet to the printing drum while the drum is rotated, a method for controlling a printing density, which comprises providing a value of D in accordance with the following equation:

$$D = \sqrt{(F/f)}$$

in which F is a pressing force at which the printing sheet is pressed to the drum, and f is a rotation speed of the drum, and regulating the value of F or f in such a manner that a variation of the value of D is kept within ±0.05 (kg·f/rpm) so that printing density is substantially maintained constant. In this case, the value of F may be monitored to regulate the value of f to keep the variation of the value of D within ±0.05 (kg·f/rpm), whereby the rotation speed of drum is controlled. Otherwise, the value of f may be monitored to regulate the value of F to keep the variation of the value of D within ±0.05 (kg·f/rpm), whereby the pressing force is controlled.

In accordance with still another aspect of the present invention, there is provided a device for controlling a printing density for use in stencil printing in which a perforated stencil sheet is wound around an outer circumferential surface of a printing drum to the inner surface of which an ink is supplied, and the ink is transferred from the printing drum to a printing sheet through the perforated stencil sheet by pressing the printing sheet to the printing drum while the drum is rotated, which comprises a means for setting a specific value of D within a range predetermined in accordance with the following equation:

$$D = \sqrt{(F/f)}$$

in which F is a possible range of pressing force at which the printing sheet is pressed to the drum, and f is a possible range of rotation speed of the drum, whereby an amount of the ink transferred to the printing sheet is controlled.

The printing density controlling device according to the present invention may comprise a printing density setting means for setting a specific value of D within said predetermined range, a printing speed setting means for calculating a possible range of f at the above-set value of D and setting a specific value of f within the calculated range, and a pressing force regulating means for calculating a value of F at the above-set values of D and f and setting the pressing force to the calculated value of F. Furthermore, in this device, the printing speed setting means may comprise an indication means which calculates a possible range of f at the above-set value of D and indicates the range of f, and a speed selecting means which allows a specific value of f to be selected from the indicated range to set a desired printing speed.

The printing density controlling device according to the present invention may comprise a printing speed setting means for setting a specific value of f to set a desired printing speed, a printing density setting means for calculating a possible range of D at the above-set value of f and setting a specific value of D within the calculated range to set a desired printing density, and a pressing force regulating means for calculating a value of F at the above-set values of D and f and setting the pressing force to the calculated value of F. Furthermore, in this device, the printing density setting means may comprise an indication means which calculates a possible range of D at the above-set value of f and indicates the range of D, and a printing density selecting means which allows a specific value of D to be selected from the indicated range to set a desired printing density.

In accordance with still another aspect of the present invention, there is provided a computer program storage medium containing a program for controlling a printing density, for use in a stencil printing in which a perforated stencil sheet is wound around an outer circumferential surface of a printing drum to the inner surface of which an ink is supplied, and the ink is transferred from the printing drum to a printing sheet through the perforated stencil sheet by pressing the printing sheet to the printing drum while the drum is rotated, said program comprising the following equation:

$$D = \sqrt{(F/f)}$$

in which F is a possible range of pressing force at which the printing sheet is pressed to the drum, and f is a possible range of rotation speed of the drum, in which said program calculates a range of f at a selected value of D or a range of D at a selected value of f, in accordance with said equation.

In the computer program storage medium above, the program may comprise the steps of storing a selected value of D, calculating a possible range of f at the stored value of D and indicating the range of f for selection, storing a value of f selected from the indicated range of f, and calculating a value of F at the stored values of D and f for setting a pressing force.

Alternatively, in the computer program storage medium above, the program may comprise the steps of storing a selected value of f, calculating a possible range of D at the stored value of f, storing a value of D selected from the range of D, and calculating a value of F at the stored values of f and D for setting a pressing force.

In the present invention, the equation $D=\sqrt{(F/f)}$ is equivalent to $D^2=(F/f)$, and selecting a value of D means selecting a value of $D^2$. Furthermore, it is also possible to derive equations expressed by, for example, $D'=a\sqrt{(F/f)}+b$ (where a and b are each an arbitrary constant). Needless to say, in the thus derived equations, selecting a value of D' means selecting a value of D.

In addition, the rotation speed f (rpm) of the printing drum is, in general, equivalent to a frequency per minute of repeated pressing of an arbitrarily fixed point of the printable outer circumferential surface of the printing drum. Thus, in an ordinary printer in which a piece of printing paper is fed per rotation of the drum, the rotation speed f (rpm) is equivalent to the number of copies finished in one minute. However, in case plural pieces of printing paper are fed per rotation of the drum, or in case only one piece of printing paper is fed while the drum rotates more than one time, the rotation speed of the drum does not necessarily agree with the printing speed, namely the number of copies finished in one minute. Furthermore, in case rotation of the drum is not constant (for instance, where the drum accelerates, decelerates or stops during one rotation), rotation speed f (rpm) of the drum meant by the present invention is derived from a surface speed of the drum at a fixed point, which can be converted into a rotation speed f (rpm).

BRIEF DESCRIPTION OF THE DRAWINGS

Hereinafter, the present invention will be described in more detail with reference to the appended drawings, in which.

DETAILED DESCRIPTION OF THE PREFERRED EMBODIMENTS

Figure 1:
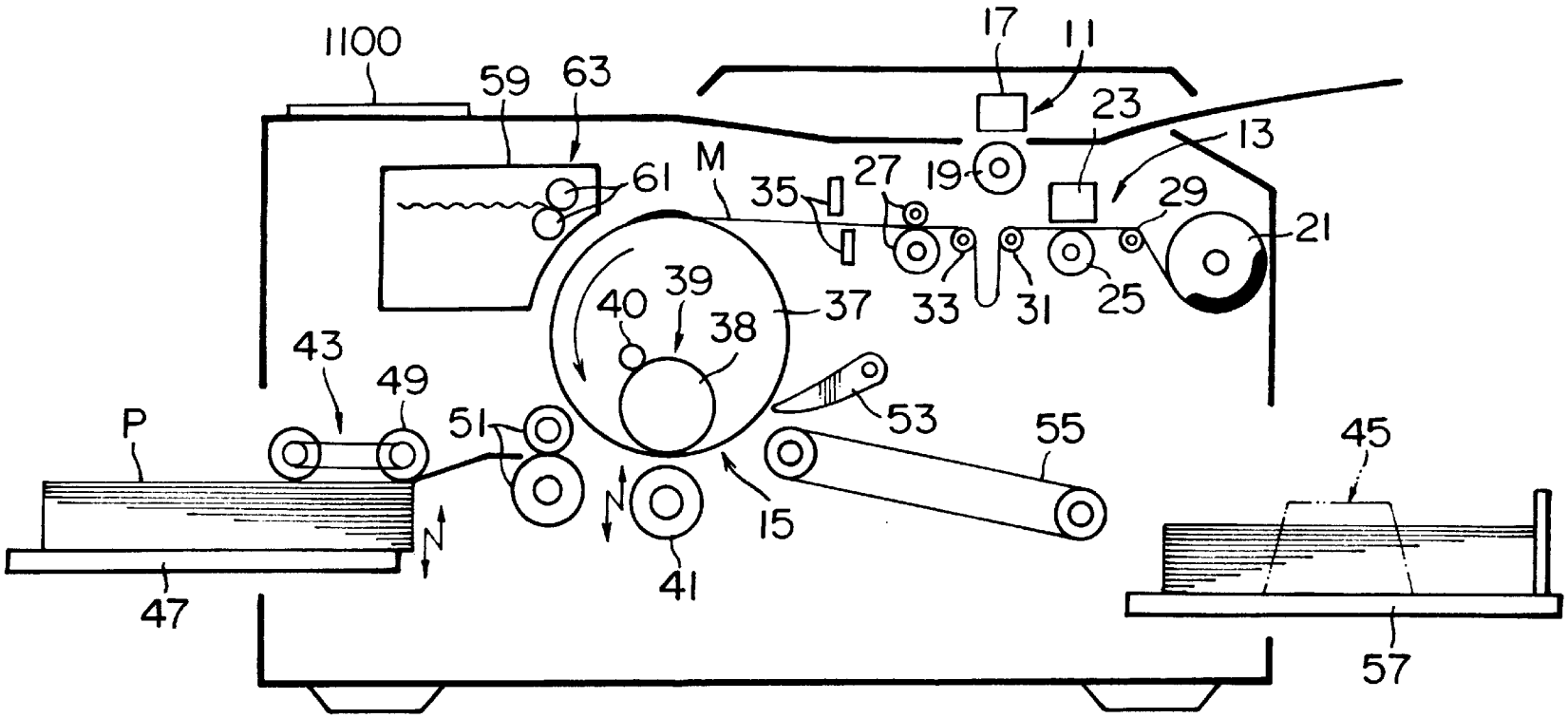
FIG. 1 is a side cross sectional view which schematically shows the inner structure of an embodiment of a stencil printing device according to the present invention.

FIG. 1 shows a preferred embodiment of the stencil printing device according to the present invention, which is equipped with a plate making function. This stencil printing device comprises an original reading unit 11, a plate making unit 13, and a printing unit 15.

The original reading unit 11 essentially consists of an image scanner, and comprises a line image sensor 17 for reading an original image of an original sheet conveyed in a secondary scanning direction, and an original sheet feeding roller 19.

The plate making unit 13 comprises a stencil sheet roll unit 21, a thermal printing head 23 consisting of a plurality of dot-like heat generating elements arranged in a lateral row, master plate sheet feeding rollers 25 and 27, master plate sheet guide rollers 29, 31 and 33, and a master plate sheet cutter 35. The dot-like heat generating elements in the thermal printing head 23 are selectively activated so that a desired thermal perforation may be carried out on the master plate sheet M, which is heat sensitive, as a plate making process, and the master plate sheet cutter 35 cuts the stencil master plate sheet M after the latter is processed into a master plate.

The printing unit 15 comprises a cylindrical printing drum 37 made of a perforated metal plate, a mesh structure or an otherwise ink permeable porous structure, an ink supplying unit 39 essentially consisting of a squeegee roller 38 and a doctor roller 40 disposed inside the printing drum 37, and a press roller 41, and the stencil master plate sheet M after being processed into a master plate is mounted on the outer circumferential surface of the printing drum 37.

On one side of the printing unit 15 is provided a paper feeding unit 43, and on the other side of the printing unit 15 is provided a paper ejecting unit 45.

The paper feeding unit 43 comprises a paper feeding table 47 on which a stack of printing paper P is placed, pick up rollers 49 for picking up the printing paper P on the paper feeding table 47 sheet by sheet, and timing rollers 51 for delivering the printing paper P to the nip between the printing drum 37 and the press roller 41.

The paper ejecting unit 45 comprises a peeling claw 53 for removing the printing paper from the printing drum 37, an ejected paper feeding belt 55, and an ejected paper table 57 for stacking up the printed printing paper.

On one side of the printing unit 15 is provided a master plate ejecting unit 63 comprising master plate ejecting rollers 61 for peeling off the used stencil master plate sheet M from the printing drum 37 and delivering it into an ejected master plate box 59.

In this stencil printing device, printing ink of a desired color is supplied by the ink supplying unit 39 into the inner surface of the printing drum 37 while the printing drum 37 is rotated counter clockwise in the drawing around its central axial line by rotative drive means not shown in the drawings. Printing paper P is delivered to the nip between the press roller 41 and the printing drum 37 after being fed by the paper feed timing rollers 51 from the left to right in synchronism with the rotation of the printing drum 37 at an appropriate timing. The printing paper P is thus pressed upon the printing drum 37 by the press roller 41 onto the stencil master plate sheet M mounted on the outer circumferential surface of the printing drum, and a stencil printing is carried out on the printing paper P by using the printing ink of the desired color.

Figure 2:
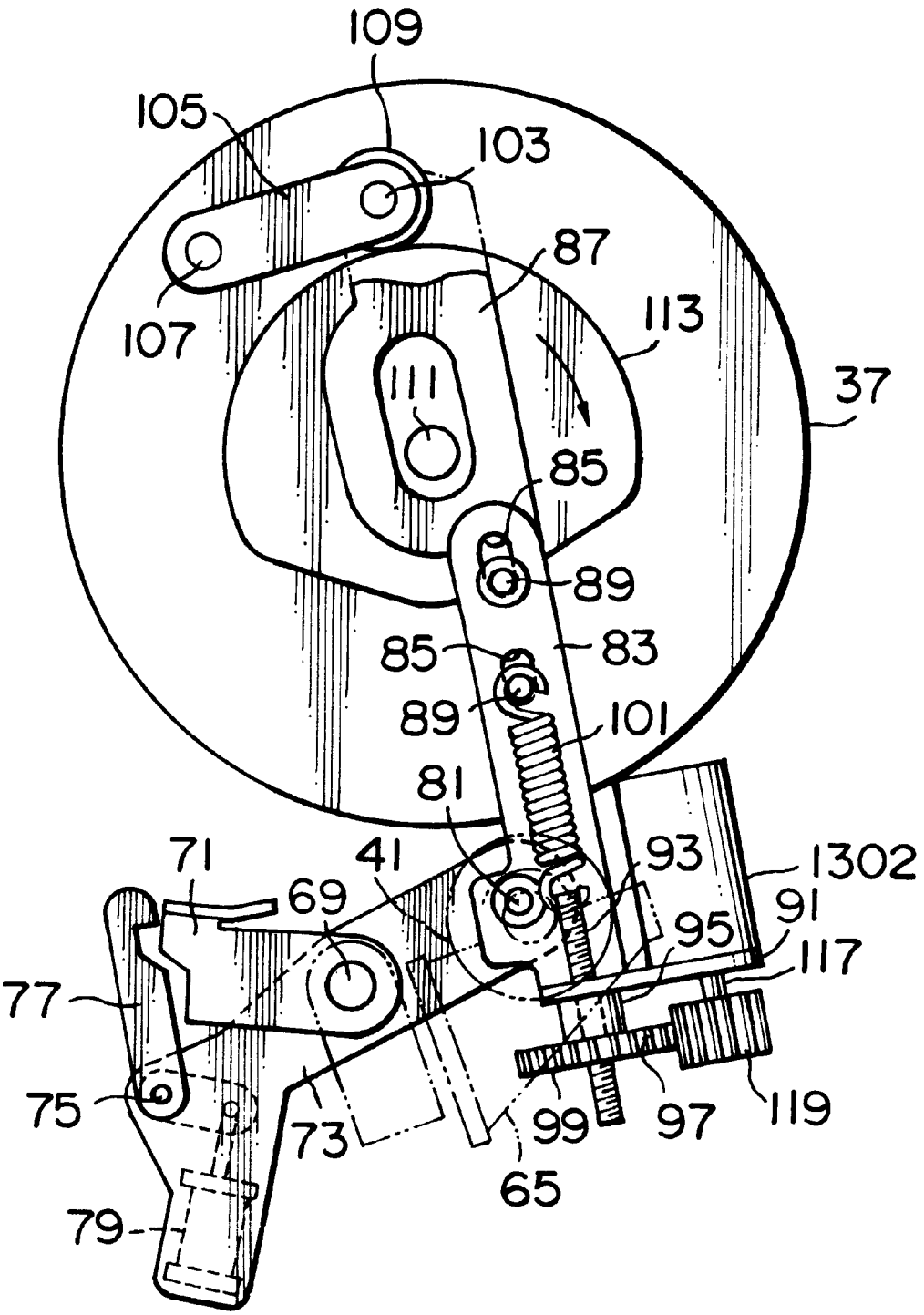
FIG. 2 is a side view of a drive unit used for the press roller shown in FIG. 1.

FIG. 2 shows the drive unit for the press roller 41. The press roller 41 is supported by a bracket 65, extending in the axial direction of the printing drum 37, so as to be rotatable around its central axial line, and the bracket 65 is in turn fixedly secured to a press shaft 69 rotatably supported by a fixed member or frame not show in the drawings. Thus, the press roller 41 is vertically rotatable around the press shaft 69, and can move between a retracted position spaced from the outer circumferential surface of the printing drum 37 and a position for pressing action engaged upon the outer circumferential surface of the printing drum 37. The press shaft 69 carries a press drive lever 71 fixedly mounted thereof, and rotatably supports a press drive plate 73.

A hook member 77 is pivotally supported on the press drive plate 73 by means of a pivot shaft 75, and selectively engages with the press drive lever 71 by being rotatively driven by a solenoid 79 mounted on the press drive plate 73 for selectively engaging the press drive lever 71 with the press drive plate 73.

An end of a first link member 83 is pivotally connected to an end of the press drive plate 73 by means of a pivot shaft 81. The first link member 83 is provided with a pair of slots 85 extending in the same direction, and these slots 85 receive pins 89 of a second link member 87. Thus, the first link member 83 and the second link member 87 are connected with each other so as to be relatively moveable in the lengthwise direction or vertically as seen in FIG. 2 within the range permitted by the slots 85.

The lower end of the first link member 83 is provided with a bent flange piece 91 through which an adjust screw 93 is passed so as to be adjustable in the direction of the reciprocating movement of the first link member 83. The adjust screw 93 threads with a nut member 99 provided with outer teeth 97 in the manner of a spur gear and supported by the lower surface of the bent flange piece 91 by way of a collar 95 against a thrust force, and the upper end of the adjust screw 93 is connected to an end of a tensile coil spring 101.

The adjust screw 93 is thus prevented from rotating by being engaged by the one end of the tensile coil spring 101, and is axially displaced with respect to the first link member 83 by the rotation of the nut member 99. The tensile coil spring 101 is engaged by one of the pins 89 at its other end, thus urging the first link member 83 upwards relative to the second link member 87, or in other words urging the press drive plate 73 in counter clockwise direction in FIG. 2 around the press shaft 69 to press the press roller 41 onto the outer circumferential surface of the printing drum 37.

The second link member 87 is pivotally connected to a free end portion of a cam lever 105 by a pivot shaft 103. The cam lever 105 is rotatably supported on a frame not shown in the drawings by a support shaft 107. The cam lever 105 rotatably supports a cam follower roller 109 in a freely rotatable manner. The cam follower roller 109 engages with a press cam 113 mounted on a main shaft 111. The main shaft 111 is rotatably supported by a frame not shown in the drawings.

The press cam 113 rotates in synchronism with the printing drum 37, and is provided with a cam profile which moves the press roller 41 to its retracted position to avoid the interference between the press roller 41 and a clamp unit when the clamp unit is located in a position coresponding to the press roller 41. The damp unit is not shown in the drawings, but disposed on an outer circumferential surface of the printing drum 37 to clamp an end of a stencil master plate sheet wound around the drum as in conventional stencil printing machines.

The bent flange piece 91 carries an electric motor 1302 for adjusting the pressing force, and a live gear 119 is fixedly secured to an output shaft 117 of the electric motor. The drive gear 119 meshes with the outer teeth 97 of the nut member 99 for transmitting the rotation of the output shaft 117 of the electric motor 1302 for adjusting the pressing force.

In this press roller drive unit, the rotation of the printing drum 37 causes the press cam 113 to rotate in the clockwise direction as seen in FIG. 2, and this rotation in turn causes a substantially vertical reciprocating movement of the second link member 87 which is transmitted to the first link member 83 via the tensile coil spring 101. The reciprocating movement of the first link member 83 causes the press drive plate 73 to angularly reciprocate around the press shaft 69, and because the hook member 77 is moved into engagement with the press drive lever 71 by the solenoid 79, the reciprocating movement of the press drive plate 73 is transmitted to the press shaft 69. Thus, the reciprocating angular movement of the press shaft 69 causes the press roller 41 to vertically rotate around the press shaft 69 so that the press roller 41 may move between the retracted position spaced from the outer circumferential surface of the printing drum 37 and the pressing position where the roller 41 is pressed against the outer circumferential surface of the printing drum 37.

The movement of the press roller 41 to the pressing position is effected by the second link member 87 being lifted, by this movement being transmitted to the first link member 83 through tensioning of the tensile coil spring 101, and by the press drive plate 73 being rotated in counter clockwise direction as seen in FIG. 2 around the press shaft 69 of the press drive plate 73. Thus, the press roller 41 is pressed against the outer circumferential surface of the printing drum 37 with the printing paper P interposed therebetween, thereby restricting any further rotation of the press drive plate 73 in counter clockwise direction as seen in FIG. 2 around the press shaft 69. The second link member 87 is further lifted until the second link member 87 moves relative to the fist link member 83 and the tensile coil spring 101 is extended. As a result, the spring force of the stretched tensile coil spring 101 presses the press roller 41 on the outer circumferential surface of the printing drum 37 with printing paper P interposed therebetween, and the magnitude of the pressing force is determined by this spring force.

For adjusting the pressing force, the electric motor 1302 for the adjustment of the pressing force is activated, and the drive gear 119 is rotated. The rotation of the driver gear 119 is transmitted to the nut member 99, and the rotation of the nut member 99 causes the adjust screw 93 to move axially relative to the first link member 83, thereby changing the position of the adjust screw 93 relative to the first link member 83. As a result, the point of engagement between the tensile coil spring 101 and the adjust screw 93 moves axially relative to the first link member 83, and this displacement causes a change in the length of the tensile coil spring 101, and hence its preset spring force. The change in the preset force of the tensile coil spring 101 changes the pressure, that is, the pressing force by which the press roller 41 is pressed against the outer circumferential surface of the printing drum 37 as described above. It can be clearly understood that such a means as a solenoid, an air cylinder and a hydraulic pressure is also usable as a means for generating the pressing force.

As described in Japanese patent publication (kokoku) No. 62-28757, the printing drum 37 for use in the present embodiment is supported on a movable support frame as a unit together with an ink bottle accommodating printing ink therein, an ink delivery pump for drawing printing ink from the ink bottle and delivering it to the supplying unit 39, and a drive motor for the ink delivery pump. The entire unit can be replaceably loaded into the body of the stencil printing device. For more details of the replaceable structure of the printing drum unit, reference should be made to Japanese patent publication (kokoku) No. 62-28757.

Figure 3:
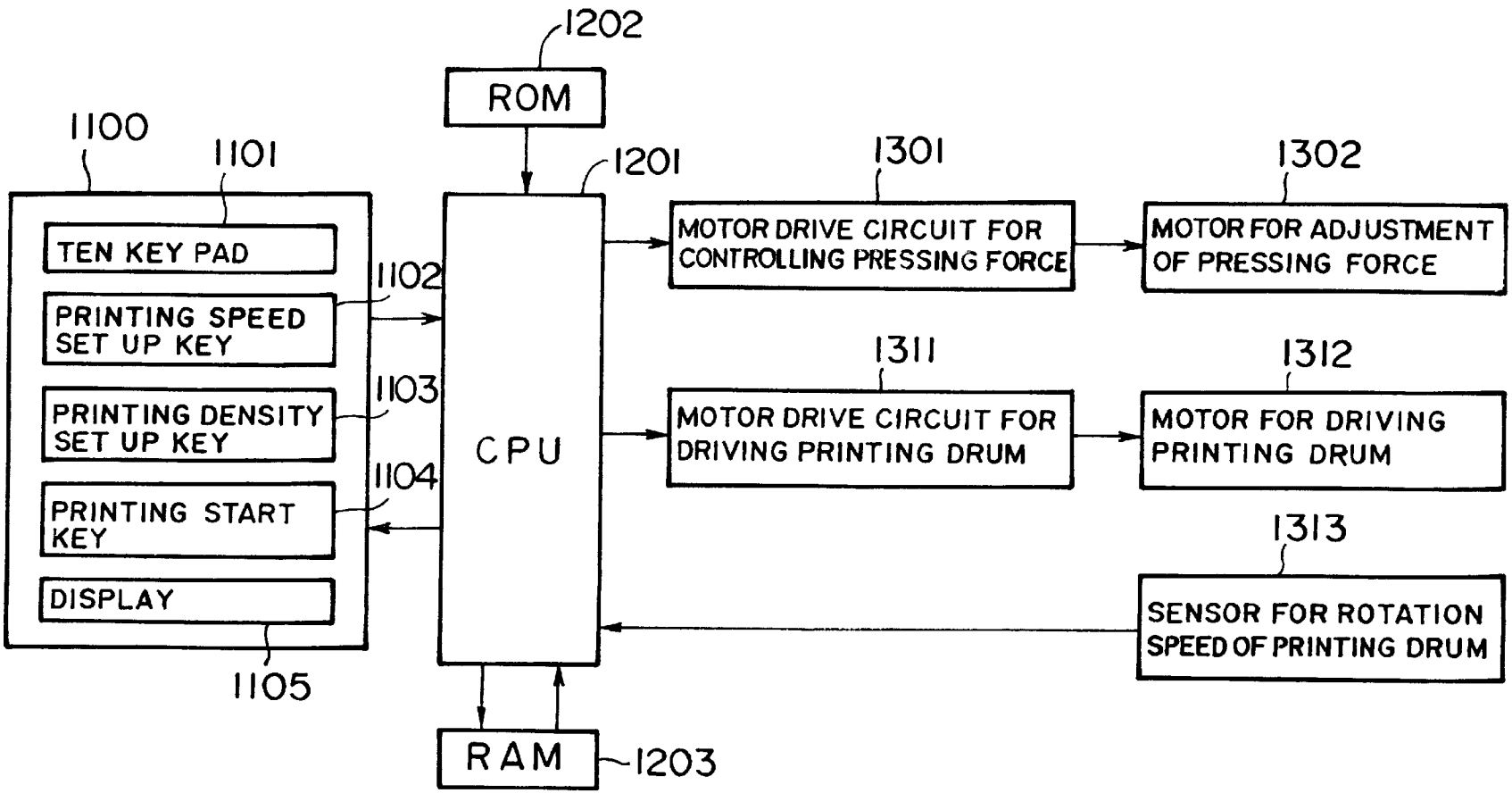
FIG. 3 is a block diagram showing an embodiment of the control unit of a stencil printing device according to the present invention.

FIG. 3 shows the control unit which totally controls the operation of the stencil printing device inclusive of the operation control of the electric motor 1302 for the adjustment of the pressing force, in which only the parts of the stencil printing device which are related to the present invention are illustrated for the simplification of description.

The control unit of FIG. 3 comprises a CPU 1201 consisting of a micro processor or something like that, a ROM 1202 storing programs for controlling the operation of various units in the stencil printing device, and a RAM 1203 storing, as required, results of arithmetic operations carried out by the micro processor and various input information.

The stencil printing device comprises an operation panel 1100 equipped with a ten key pad 1101 for setting the desired number of copies, a printing speed set up key 1102, a printing density set up key 1103, a printing start key 1104, and a display panel 1105, and the CPU 1201 receives, for instance, information on the desired number of copies set up on the ten key pad 1101; information on printing speed set up by the printing speed set up key 1102, that is, information on rotation speed of the printing drum; information on a relative printing density set by the printing density set up key 1103, that is, information on a value of $\sqrt{(F/f)}$; and information commanding a start of printing set by the printing start key 1104. Based on the input information on the printing speed, the CPU 1201 controls the drive motor 1312 for the printing drum via the motor drive circuit 1311 for driving the printing drum, and receives information on an actual rotation speed of the printing drum fed back from a rotation speed sensor 1313 for the printing drum.

The CPU 1201 determines a pressing force in performing printing based on the set value of $\sqrt{(F/f)}$ and the rotation speed of the printing drum, either by calculation or with reference to a table in which previously-calculated results are stored. The CPU 1201 also determines an operation quantity of the motor 1302 for adjustment to a targeted pressing force, and outputs the operation quantity to the motor drive circuit 1301. Furthermore, when rotation speed of the printing drum is accelerated or decelerated during printing, the motor 1302 for the adjustment of the pressing force is controlled to increase or decrease the pressing force to maintain the previously set value of $\sqrt{(F/f)}$ to be substantially constant.

Figure 4:
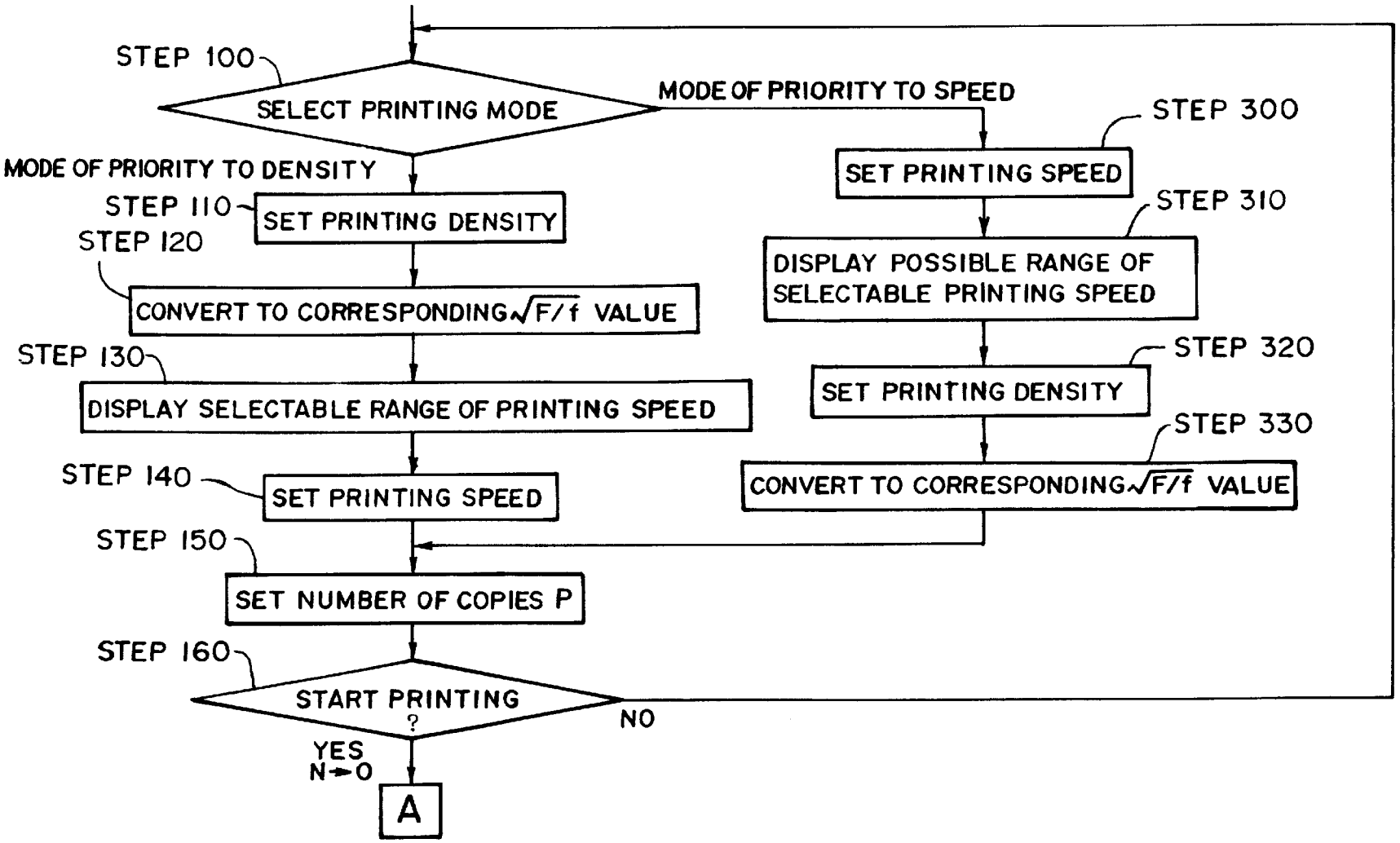
FIG. 4 is a flow chart showing a control operation of the control unit of FIG. 3 before starting printing.
Figure 5:
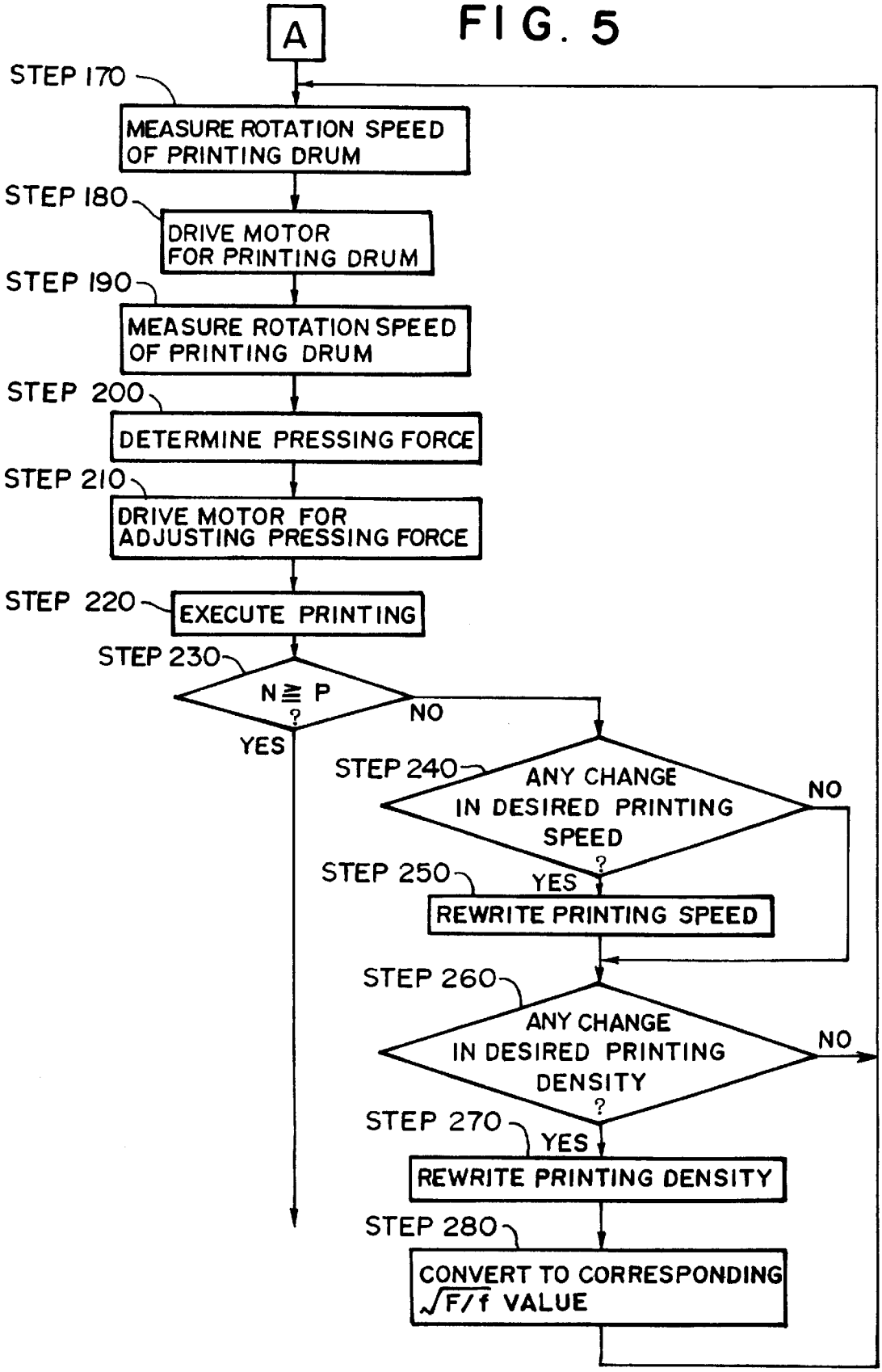
FIG. 5 is a flow chart showing a control operation of the control unit of FIG. 3. during printing.

A control flow for adjustment operation of printing density for the stencil printing device according to the present invention is shown in FIG. 4 and FIG. 5. In the control flow, a printing mode is first selected to give priority to either density or speed (step 100).

When a mode giving priority to density is selected, a desired printing density is set by the printing density set up key 1103 on the operation panel 1100. The printing density maybe set by direct input of a value of $\sqrt{(F/f)}$ by the ten key pad or the like, or may be selected by keys or a volume dial from several "dense" to "pale" levels so that the user can easily set the value.

As an example of the case not using the direct input of the value of $\sqrt{(F/f)}$, a method of indirectly setting the value of $\sqrt{(F/f)}$ by entering or selecting a numeral from a range of 1 to 20 using keys or a volume dial is described below. In a printer capable of variably controlling the pressing force in a range of from 10 to 20 kgf and the rotation speed of the printing drum in a range of from 30 to 120 rpm, the value of $\sqrt{(F/f)}$ is variable and controllable in a range of from 0.289 to 0.816. More specifically, the printing density is variable and controllable in a range the minimum printing density of which is a printing density obtained in a printing condition that yields 0.289 as a value of $\sqrt{(F/f)}$, and the maximum printing density of which is a printing density obtained in a printing condition that yields 0.816 as a value of $\sqrt{(F/f)}$.

In the printer above, the printing density may be represented by a density index n which is a value or integer between 1 and 20 corresponding to a value of $\sqrt{(F/f)}$ according to the following equation (1):

$$\sqrt{(F/f)} = (0.816 - 0.289)/(20 - 1) \times (n - 1) + 0.289 \quad (1)$$

where, n is a value of 1 or greater but not greater than 20.

In this way, a condition for the least dense printing can be set by entering numeral 1 as a density index on the operation panel 1100, which is then calculated into 0.289 as the value of $\sqrt{(F/f)}$. When a denser printing is preferred, a larger numeral n is input. If the maximum printing density is needed, a value of 20 as a density index is entered.

In this specific example, the possible range for setting the printing density corresponds to the entire range of controllable value of $\sqrt{(F/f)}$, but may be limited to a range most frequently used. Furthermore, the increment of $\sqrt{(F/f)}$ per density index is constant in equation (1), but may be partially narrowed or broadened.

In case the range of the frequently used value of $\sqrt{(F/f)}$ changes depending on variation in such factors as frequency in use, type of inks, and environmental temperature and other environmental conditions of printers, a sensor may be installed in the printer to detect a change in these factors in order that the above equation is modified or supplemented with a coefficient or a constant so as to facilitate selection of the printing density.

Then, a density index is input by operating the printing density set up key 1103 on the operation panel 1100. Let the densityindexinput here be $n_c$ (step 110). The CPU 1201 converts the density index $n_c$ into a value of $\sqrt{(F/f)}$ by calculation according to the following equation (2) or with reference to a table in which previously calculated results are stored, and stores the value in RAM 1203. Let the value of $\sqrt{(F/f)}$ calculated in accordance with the equation (2) be C (step 120):

$$C=(0.816-0.289)/(20-1)\times(n_c-1)+0.289 \quad (2)$$

From the ROM 1202, the CPU 1201 reads out the maximum and minimum values $F_{max}$ and $F_{min}$ of the pressing force controllable by the printer, as well as the maximum and minimum values $f_{max}$ and $f_{min}$ of the rotation speed of the printing drum controllable by the printer. Then, values of $f_a$ and $f_b$ are determined by calculation in accordance with the equation (3) below, or with reference to a table in which previously calculated results are stored.

$$f_a=F_{min}/C^2$$
$$f_b=F_{max}/C^2 \quad (3)$$

As a result of calculation, if $f_a$ is not greater than $f_{min}$, $f_{min}$ is set as the minimum value of the controllable rotation speed of the printing drum, and if $f_{min}$ is not greater than $f_a$, $f_a$ is set as the minimum value. Similarly, if $f_{max}$ is not greater than $f_b$, $f_{max}$ is set as the maximum value, and if $f_b$ is not larger than $f_{max}$, $f_b$ is set as the maximum value of the controllable rotation speed of the printing drum. Then, the maximum value and the minimum value thus determined are displayed on the operation panel 1100 (step 130).

Then, the user inputs information on the rotation speed of the printing drum by selecting a value from the range of the rotation speed displayed on the panel using the printing speed set up key 1102, and the input value is then stored in the RAM 1203. Let the rotation speed of the printing drum set in this step be $f_c$ (step 140).

When a mode giving priority to printing speed is selected, a desired rotation speed of the printing drum is set by the printing speed set up key 1102 provided on the operation panel 1100, so that information on the rotation speed of the printing drum is stored in the RAM 1203. Let the rotation speed of the printing drum set herein be $f_d$ (step 300).

The CPU 1201 reads out, from the ROM 1202, the maximum and minimum values $F_{max}$ and $F_{min}$ of the pressing force controllable by the printer, and also reads out the rotation speed of the printing drum $f_d$ from the RAM 1203. Then, the maximum value $n_{max}$ and the minimum value $n_{min}$ of the selectable density index are determined by calculation in accordance with the equation (4) below, or with reference to a table in which previously calculated results are stored.

$$n_{\min} = 1 + \left\{\sqrt{(F_{\min}/f_d)} - 0.289\right\} \times (20 - 1)/(0.816 - 0.289) \quad (4)$$

$$n_{\max} = 1 + \left\{\sqrt{(F_{\max}/f_d)} - 0.289\right\} \times (20 - 1)/(0.816 - 0.289)$$

The operation panel 1100 displays a range of selectable printing density indices, in which $n_{min}$ is the least dense printing density, and $n_{max}$ is the most dense printing density (step 310).

A desired printing density is input by selecting a density index from the range of the density indices displayed on the operation panel 1100 using the printing density set up key 1103. Let the density index set here be $n_d$ (step 320).

The CPU 1201 determines the value of $\sqrt{(F/f)}$ by calculation according to the equation (5) below or with reference to a table in which previously calculated results are stored, and stores the value in RAM 1203. Let the value of $\sqrt{(F/f)}$ calculated in accordance with equation (5) be D (step 330):

$$D=(0.816-0.289)/(20-1)\times(n_d-1)+0.289 \quad (5)$$

The number of copies is set by entering the ten key pad 1101 on the operation panel 1100, and the copy number information is stored in the RAM 1203 (step 150).

It is then monitored if the print start key provided on the operation panel 1100 is keyed in or not; that is, it is monitored whether printing is to be started or not (step 160). If printing is to be started, the printing drum starts to be driven to the set rotation speed. Whether rotation of the printing drum is accelerated to the set rotation speed from stopped state or from rotated state during printing, an abrupt change in speed is unfavorable, and a moderate change in printing speed is preferred. On the other hand, since printing density depends on rotation speed of the printing drum, printing density should be adjusted by pressing force if the printing speed is changed. The present embodiment employs, as described below with reference to FIG. 5, a method in which a compensation amount of pressing force is properly determined in response to variation in monitored rotation speed of the printing drum. However, the method for compensation may be such that determines a rotation speed of the printing drum in response to variation in the pressing force being monitored.

Referring to FIG. 5, first of all, the CPU 1201 collects information on rotation speed of the printing drum from a rotation speed sensor such as a rotary encoder fitted to the printing drum or a motor for driving the printing drum (step 170). Let the observed rotation speed of the printing drum be $f_{t1}$ and a desired rotation speed of the printing drum stored in the RAM 1203 be $f_e$. The CPU 1201 compares $f_{t1}$ with $f_e$,and if the difference between them is 30 rpm or more, a control signal is output to the motor drive circuit 1311 for accelerating or decelerating the printing drum by 30 rpm. When the difference is less than 30 rpm, a control signal is output to the motor drive circuit 1311 for driving the printing drum to match $f_{t1}$ with $f_e$ (step 180).

After the speed has been changed in accordance with the control signal, the CPU 1201 reads rotation speed information of the printing drum again (step 190). Let the observed rotation speed of the printing drum be $f_{t2}$ and the value of the density information $\sqrt{(F/f)}$ set in the RAM 1203 be E. Then, the CPU 1201 determines a proper pressing force by calculation according to the equation (6) below or with reference to a table in which previously calculated results are stored (step 200).

$$F_{t2}=f_{t2}\times E^2 \tag{6}$$

Then, the CPU 1201 outputs an operation signal to the motor drive circuit 1301 for controlling the pressing force in such a manner that the calculated proper pressing force should be realized. The motor 1302 for adjustment of pressing force is driven in accordance with the thus output signal, and the nut member 99 is rotated so that the pressing force is set at a proper value while the tensioning of the tensile coil spring 101 is optimized (step 210).

The counter value N is incremented every time printing is executed on a sheet of printing paper, and the counter value is rewritten (step 220). The number of copies P is compared with the counter value N, and printing is stopped when N is a value not smaller than P (step 230). If N is smaller than P, it is confirmed whether the desired printing speed is changed or not during the printing operation (step 240). If the desired rotation speed of the printing drum is changed to $f_g$, the rotation speed of the printing drum stored in RAM 1203 is rewritten from $f_e$ to $f_g$ (step 250). Then, it is confirmed whether the desired printing density is changed or not during the printing operation (step 260). If the desired density index is changed to $n_h$, it is converted into a corresponding value H of $\sqrt{(F/f)}$ (step 270), and the value E of $\sqrt{(F/f)}$ stored in RAM 1203 is rewritten to H (step 280). The information on changes in the rotation speed of the printing drum and the printing density is reflected to steps 180 and 200, and the rotation speed of the printing drum and the pressing force are adjusted accordingly.

EXAMPLE

Printing was performed using a rotary stencil printing device shown in FIG. 1 controlled by the method for controlling the printing density according to the present invention and under various printing conditions differing in the value of $\sqrt{(F/f)}$. A gray chart having an image area ratio of 11%, which is sensitive to slight change in printing density, was used as an original. Commercially available stencil sheets Model GR76W, manufactured by Riso Kagaku Corporation) were processed to obtain masters for stencil printing under the same conditions, and sheets of wood-free paper (Riso A3-size printing paper manufactured by Riso Kagaku Corporation) were printed by use of a commercially available stencil printing ink (GR ink, black, manufactured by Riso Kagaku Corporation) as a printing ink.

Rotation speed of the printing drum was measured in unit of rpm by using a rotary encoder. The pressing force of the press roller was measured in unit of kg f by a load cell which was pressed by the entire press roller while the press roller is under pressing operation by the drive unit. Printing density of printed image was evaluated by using a reflection densitometer (Model RD 920 manufactured by Macbeth Corp.), as well as by visual observation. The results of evaluation are shown in Tables 1 and 2.

TABLE 1

| | | | | | | | | | | |
|---|---|---|---|---|---|---|---|---|---|---|
| Rotation speed of printing drum (rpm) | 30 | 30 | 45 | 60 | 80 | 45 | 100 | 120 | 80 | 120 |
| Pressing force (kg · f) | 20 | 15 | 17 | 15 | 20 | 11 | 17 | 20 | 13 | 11 |
| Value of √ (F/f) | 0.82 | 0.71 | 0.62 | 0.50 | 0.50 | 0.49 | 0.41 | 0.41 | 0.40 | 0.30 |
| Reflection density | 0.27 | 0.25 | 0.23 | 0.20 | 0.20 | 0.19 | 0.17 | 0.17 | 0.17 | 0.15 |
| Difference in value of √ (F/f) | 0.11 | | 0.08 | | 0.01 | | | 0.01 | | |
| Visual observation on printing density | + | | + | | − | | | − | | |

Note:
+ means that a difference in density was observed.
− means that no difference in density was observed.

TABLE 2

| | | | | | | | | | | |
|---|---|---|---|---|---|---|---|---|---|---|
| Rotation speed of printing drum (rpm) | 30 | 30 | 30 | 45 | 60 | 80 | 80 | 120 | 100 | 120 |
| Pressing force (kg · f) | 20 | 18 | 15 | 20 | 16 | 18 | 13 | 15 | 12 | 11 |
| Value of √ (F/f) | 0.82 | 0.77 | 0.71 | 0.67 | 0.52 | 0.47 | 0.40 | 0.35 | 0.35 | 0.30 |
| Reflection density | 0.27 | 0.26 | 0.25 | 0.24 | 0.20 | 0.19 | 0.17 | 0.16 | 0.16 | 0.15 |
| Difference in value of √ (F/f) | 0.05 | | 0.04 | | 0.05 | | 0.05 | | 0.05 | |
| Visual observation on printing density | − | | − | | − | | − | | − | |

Note:
+ means that a difference in density was observed.
− means that no difference in density was observed.

From Tables 1 and 2, it can be seen that the value of $\sqrt{(F/f)}$ is substantially proportional to printing density, and that the printing density can be controlled as desired by using the value of $\sqrt{(F/f)}$. It has also been found that even when the rotation speed of the printing drum is varied, a stable printing density can be realized by selecting a pressing force so as to maintain the value of $\sqrt{(F/f)}$ constant. Furthermore, it has been found that so long as variation in the value of $\sqrt{(F/f)}$ falls within ±0.05, no difference in printing density is visually distinguishable.

Data on Tables 1 and 2 were obtained using a press roller of 0.31 m in length. Further, printing was performed in the same manner as above, except that a press roller of different length was used. The results are shown in Table 3.

TABLE 3

| | | | | | | | | | | |
|---|---|---|---|---|---|---|---|---|---|---|
| Length of press roller W (m) | 0.31 | 0.31 | 0.31 | 0.31 | 0.21 | 0.21 | 0.21 | 0.062 | 0.062 | 0.062 |
| Pressing force F (kg · f) | 20 | 40 | 80 | 100 | 14 | 50 | 70 | 10 | 16 | 20 |
| Rotation speed of printing drum f(rpm) | 30 | 60 | 120 | 150 | 30 | 110 | 150 | 15 | 24 | 30 |
| F/W | 64.5 | 129.0 | 258.1 | 322.6 | 66.7 | 238.1 | 333.3 | 161.3 | 258.1 | 322.6 |
| Value of √ (F/f) | 0.82 | 0.82 | 0.82 | 0.82 | 0.68 | 0.67 | 0.68 | 0.82 | 0.82 | 0.82 |
| Value of √ (F/(f · W)) | 1.47 | 1.47 | 1.47 | 1.47 | 1.49 | 1.47 | 1.49 | 3.28 | 3.28 | 3.28 |
| Reflection density D | 0.27 | 0.28 | 0.28 | 0.27 | 0.28 | 0.28 | 0.27 | 0.50 | 0.51 | 0.51 |
| Visual observation on printing density | | | – | | | – | | | – | |

Note:
+ means that a difference in density was observed.
– means that no difference in density was observed.

From Table 3, it has been confirmed that the value of $\sqrt{(F/f)}$ is useful for controlling printing density on press rollers of different length. Also, it has been confirmed from Tables 1 to 3 that printing density is proportional to the value of $\sqrt{(F/(f \cdot W))}$ as it is shown by an equation of $D=0.128\sqrt{(F/(f \cdot W))}+0.087$, regardless of length of press rollers.

As can be understood from the above description, according to the present invention, the value of $\sqrt{(F/f)}$ or $\sqrt{(F/(f \cdot W))}$ is found to be an index useful for controlling printing density without necessity of laborious experiments on a vast number of combinations of rotation speed of the printing drum with pressing force applied to printing paper against the printing drum. According to the present invention, a combination of the rotation speed with the pressing force to yield a constant printing density can readily be determined. Thus, the present invention enables a wide and fine adjustment of printing density while making the best use of performance of a stencil printing device.

Although the present invention has been described in terms of a specific embodiment thereof, it is possible to modify and alter details thereof without departing from the spirit and scopes of the present invention.

I claim:

1. In a stencil printing in which a perforated stencil sheet is wound around a circumferential surface of a printing drum to which an ink is supplied, and the ink is transferred from the printing drum to a printing sheet through the perforated stencil sheet by pressing the printing sheet to the printing drum while the drum is rotated, a method for controlling a printing density comprises controlling an amount of an ink transferred to a printing sheet by selecting a specific value of D from a range predetermined in accordance with the following equation:

$$D = \sqrt{(F/f)}$$

in which F is a possible range of pressing force at which the printing sheet is pressed to the drum, and f is a possible range of rotation speed of the drum.

2. A printing density controlling method according to claim 1, which comprises a first step of selecting a specific value of D from said predetermined range in order to set a desired printing density, a second step of calculating a possible range of f at the selected value of D and selecting a specific value of f from the calculated range in order to set a desired printing speed, and a third step of calculating a pressing force of F at the selected values of D and f in order to set a pressing force.

3. A printing density controlling method according to claim 2, in which said second step comprises a step of calculating a possible range of f at the selected value of D and indicating the calculated range of f, and a step of selecting a specific value of f from the indicated range in order to set a desired printing speed.

4. A printing density controlling method according to claim 1, which comprises a first step of selecting a specific value of f in order to set a desired printing speed, a second step of calculating a possible range of D at the selected value of f and selecting a specific value of D from the calculated range in order to set a desired printing density, and a third step of calculating a pressing force of F at the selected values of D and f in order to set a pressing force.

5. A printing density controlling method according to claim 4, in which said second step comprises a step of calculating a possible range of D at the selected value of f and indicating the calculated range of D, and a step of selecting a specific value of D from the indicated range in order to set a desired printing density.

6. In a stencil printing in which a perforated stencil sheet is wound around a circumferential surface of a printing drum to which an ink is supplied, and the ink is transferred from the printing drum to a printing sheet through the perforated stencil sheet by pressing the printing sheet to the printing drum while the drum is rotated, a method for controlling a printing density comprises providing a value of D in accordance with the following equation:

$$D = \sqrt{(F/f)}$$

in which F is a pressing force at which the printing sheet is pressed to the drum, and f is a rotation speed of the drum, and regulating the value of F or f in such a manner that a variation of the value of D is kept within ±0.05 (kg·f/rpm) so that printing density is substantially maintained constant.

7. A printing density controlling method according to claim 6, in which the value of F is monitored, and the value of f is regulated to keep the variation of the value of D within ±0.05 (kg·f/rpm), whereby the rotation speed of drum is controlled.

8. A printing density controlling method according to claim 6, in which the value of f is monitored, and the value of F is regulated to keep the variation of the value of D within ±0.05 (kg·f/rpm), whereby the pressing force is controlled.

9. A device for controlling a printing density for use in a stencil printing in which a perforated stencil sheet is wound around a circumferential surface of a printing drum to which an ink is supplied, and the ink is transferred from the printing drum to a printing sheet through the perforated stencil sheet by pressing the printing sheet to the printing drum while the drum is rotated, which comprises a means for setting a specific value of D within a range predetermined in accordance with the following equation:

$$D = \sqrt{(F/f)}$$

in which F is a possible range of pressing force at which the printing sheet is pressed to the drum, and f is a possible range of rotation speed of the drum, whereby an amount of the ink transferred to the printing sheet is controlled.

10. A printing density controlling device defined in claim 9, which comprises a printing density setting means for setting a specific value of D within said predetermined range, a printing speed setting means for calculating a possible range of f at the above-set value of D and setting a specific value of f within the calculated range, and a pressing force regulating means for calculating a value of F at the above-set values of D and f and setting the pressing force to the calculated value of F.

11. A printing density controlling device defined in claim 10, in which said printing speed setting means comprises an indication means which calculates a possible range of f at the above-set value of D and indicates the range of f, and a speed selecting means which allows a specific value of f to be selected from the indicated range to set a desired printing speed.

12. A printing density controlling device defined in claim 9, which comprises a printing speed setting means for setting a specific value of f to set a desired printing speed, a printing density setting means for calculating a possible range of D at the above-set value of f and setting a specific value of D within the calculated range to set a desired printing density, and a pressing force regulating means for calculating a value of F at the above-set values of D and f and setting the pressing force to the calculated value of F.

13. A printing density controlling device defined in claim 12, in which said printing density setting means comprises an indication means which calculates a possible range of D at the above-set value of f and indicates the range of D, and a printing density selecting means which allows a specific value of D to be selected from the indicated range to set a desired printing density.

14. A computer program storage medium containing a program for controlling a printing density, for use in a stencil printing in which a perforated stencil sheet is wound around a circumferential surface of a printing drum to which an ink is supplied, and the ink is transferred from the printing drum to a printing sheet through the perforated stencil sheet by pressing the printing sheet to the printing drum while the drum is rotated, said program comprising the following equation:

$$D = \sqrt{(F/f)}$$

in which F is a possible range of pressing force at which the printing sheet is pressed to the drum, and f is a possible range of rotation speed of the drum, in which said program calculates a range of f at a selected value of D or a range of D at a selected value of f, in accordance with said equation.

15. A computer program storage medium according to claim 14, in which said program comprises the following steps of storing a selected value of D, calculating a possible range of f at the stored value of D, storing a value of f selected from the range of f, and calculating a value of F at the stored values of D and f for setting a pressing force.

16. A computer program storage medium according to claim 15, in which said program comprises the following steps of storing a selected value of D, calculating a possible range of f at the stored value of D and indicating the range of f for selection, storing a value of f selected from the indicated range of f, and calculating a value of F at the stored values of D and f for setting a pressing force.

17. A computer program storage medium according to claim 14, in which said program comprises the following steps of storing a selected value of f, calculating a possible range of D at the stored value of f, storing a value of D selected from the range of D, and calculating a value of F at the stored values of f and D for setting a pressing force.

18. A computer program storage medium according to claim 17, in which said program comprises the following steps of storing a selected value of f, calculating a possible range of D at the stored value of f and indicating the range of D for selection, storing a value of D selected from the indicated range of D, and calculating a value of F at the stored values of f and D for setting a pressing force.

* * * * *